US005183246A

United States Patent [19]

Edwards et al.

[11] Patent Number: 5,183,246

[45] Date of Patent: Feb. 2, 1993

[54] DIVERTING APPARATUS AND METHOD FOR IN-LINE INSERTING EQUIPMENT

[75] Inventors: Robert J. Edwards, Ridgefield; Harry E. Luperti, Bethel, both of Conn.

[73] Assignee: Pitney Bowes Inc., Stamford, Conn.

[21] Appl. No.: 781,050

[22] Filed: Oct. 21, 1991

[51] Int. Cl.[5] ..... B42C 1/00; B31F 1/00

[52] U.S. Cl. ..... 270/45; 270/32; 493/420; 493/421

[58] Field of Search ..... 270/8, 32, 45, 47; 493/419, 420, 421

[56] References Cited

U.S. PATENT DOCUMENTS

| | | | |
|---|---|---|---|
| 1,803,370 | 5/1931 | Tufts | 493/419 |
| 3,428,309 | 2/1969 | Brozo . | |
| 4,235,434 | 11/1980 | Muller . | |
| 4,486,015 | 12/1984 | Takahaski . | |
| 4,499,834 | 2/1985 | Ruetschle et al. | 270/53 X |
| 4,585,219 | 4/1986 | Lehmann et al. | 493/419 X |
| 4,717,134 | 1/1988 | Iida et al. | 270/39 |
| 4,834,699 | 5/1989 | Martin | 493/420 X |
| 4,842,574 | 6/1989 | Noble et al. | 493/421 |
| 4,898,570 | 2/1990 | Luperti et al. | 270/45 X |
| 4,900,391 | 2/1990 | Mandel et al. | 270/45 X |
| 4,997,175 | 3/1991 | Hashida et al. | 270/45 |
| 5,022,638 | 6/1991 | Ifkovits, Jr. . | |
| 5,076,556 | 12/1991 | Mandel | 270/47 X |
| 5,090,671 | 2/1992 | Gombault et al. | 270/45 |

*Primary Examiner*—Edward K. Look
*Assistant Examiner*—John Ryzinc
*Attorney, Agent, or Firm*—Charles R. Malandra, Jr.; Melvin J. Scolnick

[57] ABSTRACT

An apparatus for diverting individual sheets and stacks of sheets from being folded comprises a buckle chute folder having a pair of feed rollers, which form an entrance nip to the buckle chute, and at least one buckle chute. There is a stop member assembly adjacent the buckle chute. The stop member assembly includes a plurality of stop fingers coupled to a solenoid, wherein operation of the solenoid moves the stop fingers from a fold position to a divert position.

In one embodiment, the solenoid is a rotary solenoid, with the stop fingers being coupled to the shaft of the rotary solenoid. The stop fingers extend through the buckle chute when the solenoid is de-energized, and the stop fingers pivot out of the chute when the solenoid is energized. The sheets being conveyed into the buckle chute by the feed rollers engage the stop fingers to initiate a fold in the sheets when the stop fingers are in a fold position. Thesheets are conveyed through the buckle chute without a fold when the stop fingers are in the divert position. The buckel chute has an divert end opposite an entrance end adjacent to the feed rollers.

12 Claims, 4 Drawing Sheets

DIVERTING APPARATUS AND METHOD FOR IN-LINE INSERTING EQUIPMENT

FIELD OF THE INVENTION

The present invention relates to inserting machines, and more particularly, to inserting machines having an in-line buckle chute folder.

BACKGROUND OF THE INVENTION

Buckle chute folders are well known in the field of sheet material handling. Typically, a buckle chute folder comprises four or more fold rollers operating in cooperation with two or more buckle chutes and deflectors to fold one or more sheets. A conventional buckle chute includes a stop bar which is adjustably positioned within the chute for folding the sheets to a particular dimension. In operation, a first pair of rollers feeds a stack of sheets (or single sheet) into the first buckle chute. When the leading edge of the stack hits the stop bar in the chute, the first pair of rollers continue to feed the remaining portion of the stack causing the stack to buckle. The buckled portion of the stack is then engaged by another pair of rollers which make the fold in the stack. Examples of buckle chute folders are described in U.S. Pat. No. 4,898,570 issued on Feb. 6, 1990 to H. Luperti, et al. and assigned to the assignee of the present invention; and U.S. Pat. No. 4,842,574 issued on Jun. 26, 1989 to N. Noble.

A known limitation to using buckle chute folders is that buckle chute folders are suitable for folding a limited number of sheets. The proper spacing of the rollers is essential for obtaining the proper fold of a limited number of sheets. When the gap between the roller pairs are set for the feeding and folding of single sheets, there is an inherent limit in the number of sheets that can be folded depending on the characteristics of the sheet material. Typically, a buckle chute folder configured to fold single sheets, will not work well for folding more than 12 or 14 sheets at a time. For inserting machines including buckle chute folders, a stack containing more than 14 sheets must be removed before being folded by the buckle chute folder. Previously, this has required stopping the inserter so that the stack can be manually removed so as to avoid jamming the folder or obtaining a poor fold. An alternative approach to stopping the machine is to divert the large stack from the normal paper path by adding a diverting apparatus upstream from the buckle chute folder.

There are other reasons for diverting sheets from the normal processing path of an inserter, for example, an incomplete stack has been detected. Typically, the devices used to divert sheets from the normal processing path of the inserter machine require the addition of modules or replacing modules in the typical in-line inserter machine configuration. An example of an added module is disclosed in U.S. Pat. No. 5,096,176, issued on Mar. 17, 1992, and assigned to the assignee of the present invention. This module diverts accumulated stacks to a separate bin prior to the stacks being conveyed to the folder. The addition of such a module adds significantly to the size, cost and complexity of the inserter machine. It is also well known to automatically divert stacks that have count, sequence or scanning errors. Generally, this is done at a reject station in the inserter after the stack has been folded and inserted into an envelope.

In U.S. Pat. No. 4,499,834 issued on Feb. 19, 1985 to Ruetschle, et al., there is disclosed a buckle folder having a first deflector which includes a folder gate that is in one position to effect the fold on the sheets and in a second position to bypass the passage through the buckle folder. The buckle folder is situated downstream from a stitcher device that stitches the stack of sheets before the stack is conveyed to the folder. The deflector/gate arrangement disclosed in Ruetschle is not suitable for use with a buckle chute folder because the nature of a buckle chute folder is that the stack is fed into a combination of chutes and chute deflectors.

SUMMARY OF THE INVENTION

It has been found that the present invention provides a means for diverting single sheets and stacks of sheets from the normal processing path of an in-line inserter by modifying a conventional buckle chute folder. The buckle chute folder can be modified so that the stops pivot out of the chute to enable the sheets to pass completely through the chute to a separate paper path. In this arrangement, the buckle chute folder can be controlled to either fold sheets in predetermined arrangement or to pass the sheets through the chute to the second path or a collection bin.

It has been found that the present invention minimizes the cost and apparatus for adding a diverting station to an in-line inserting machine. Because no additional equipment is added to the normal processing path, the present invention adds a diverting feature for an in-line inserter without adding to the normal processing time. Furthermore, it has been found that the present invention can be retrofitted to existing in-line inserting equipment to add a diverting feature to the existing equipment.

In accordance with the present invention, an apparatus is provided for diverting individual sheets and stacks of sheets from being folded. The apparatus comprises a buckle chute folder having a pair of feed rollers, which form an entrance nip to the buckle chute, and at least one buckle chute. There is a stop member assembly adjacent the buckle chute. The stop member assembly includes a plurality of stop fingers coupled to a solenoid, wherein operation of the solenoid moves the stop fingers from a fold position to a divert position.

In the preferred embodiment, the solenoid is a rotary solenoid, with the stop fingers being coupled to the shaft of the rotary solenoid. The stop fingers extend through the buckle chute when the solenoid is de-energized, and the stop fingers pivot out of the chute when the solenoid is energized. The sheets being conveyed into the buckle chute by the feed rollers engage the stop fingers to initiate a fold in the sheets when the stop fingers are in a fold position. The sheets are conveyed through the buckle chute without a fold when the stop fingers are in the divert position. The buckle chute has an divert end opposite an entrance end adjacent to the feed rollers.

BRIEF DESCRIPTION OF THE DRAWINGS

Complete understanding of the present invention may be obtained from the following detailed description of the preferred embodiment thereof, when taken in conjunction with the accompanying drawings wherein like reference numerals designate similar elements in the various figures, and in which.

DETAILED DESCRIPTION OF THE PRESENT INVENTION

Figure 1:
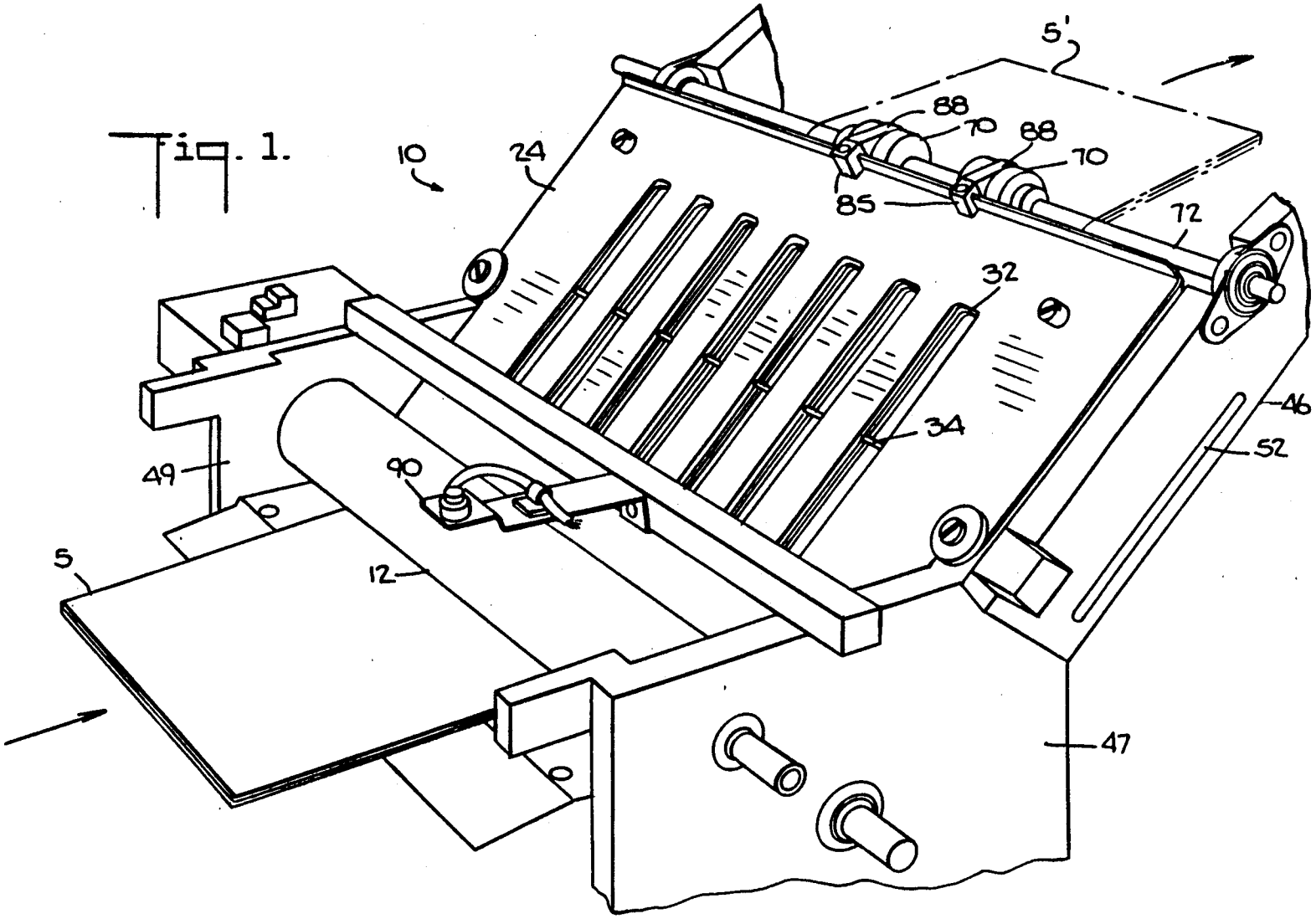
FIG. 1 is a perspective view of a buckle chute folder embodying the present invention.

In describing the preferred embodiment of the present invention, reference is made to the drawings wherein there is seen in FIGS. 1-5 a buckle chute folder, generally designated 10, consisting of six fold rollers 12, 14, 16 18, 20 and 22, two buckle chutes 24 and 26, and two deflectors 28 and 30. Chutes 24 and 26 have a plurality of slots 32 through which stop fingers 34 project. For individual sheets or stack of sheets conveyed through folder 10, chute 24 is operative to initiate a first fold and chute 26 initiates a second fold in the sheets. Stop fingers 34 are part of stop bar 36.

At chute 26, stop bar 36 is part of a conventional stop assembly 38 in which stop bar 36 is adjustably mounted to a vertical center plate 40 rigidly coupled to the center back of chute 26. Thumb screw 42 secures bar 36 to plate 40 after stop bar 36 is positioned at the appropriate location for stop fingers 34 to effect the desired second fold.

Figure 2:
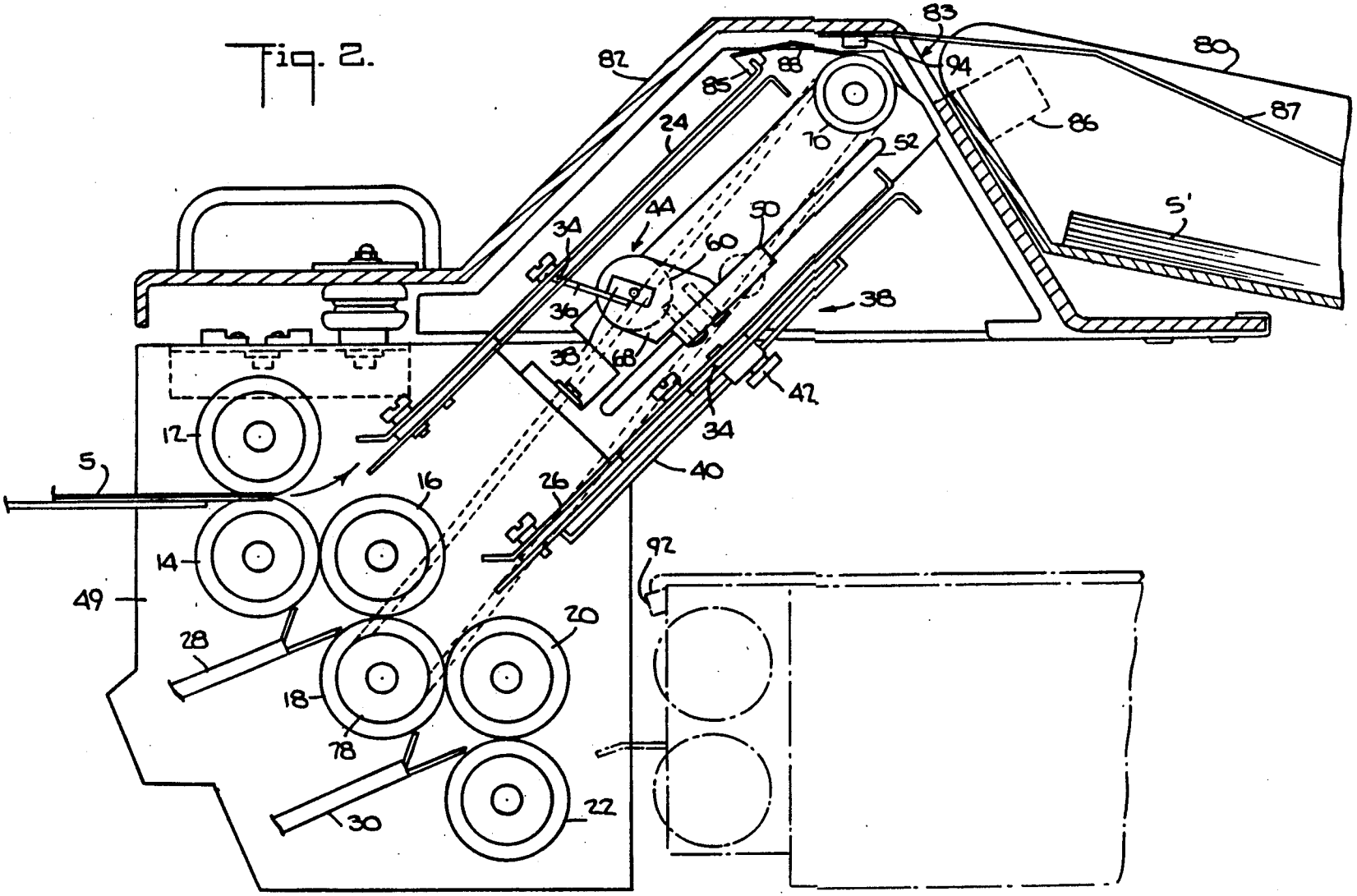
FIG. 2 is a side elevational view of the buckle chute folder seen in FIG. 1.
Figure 3:
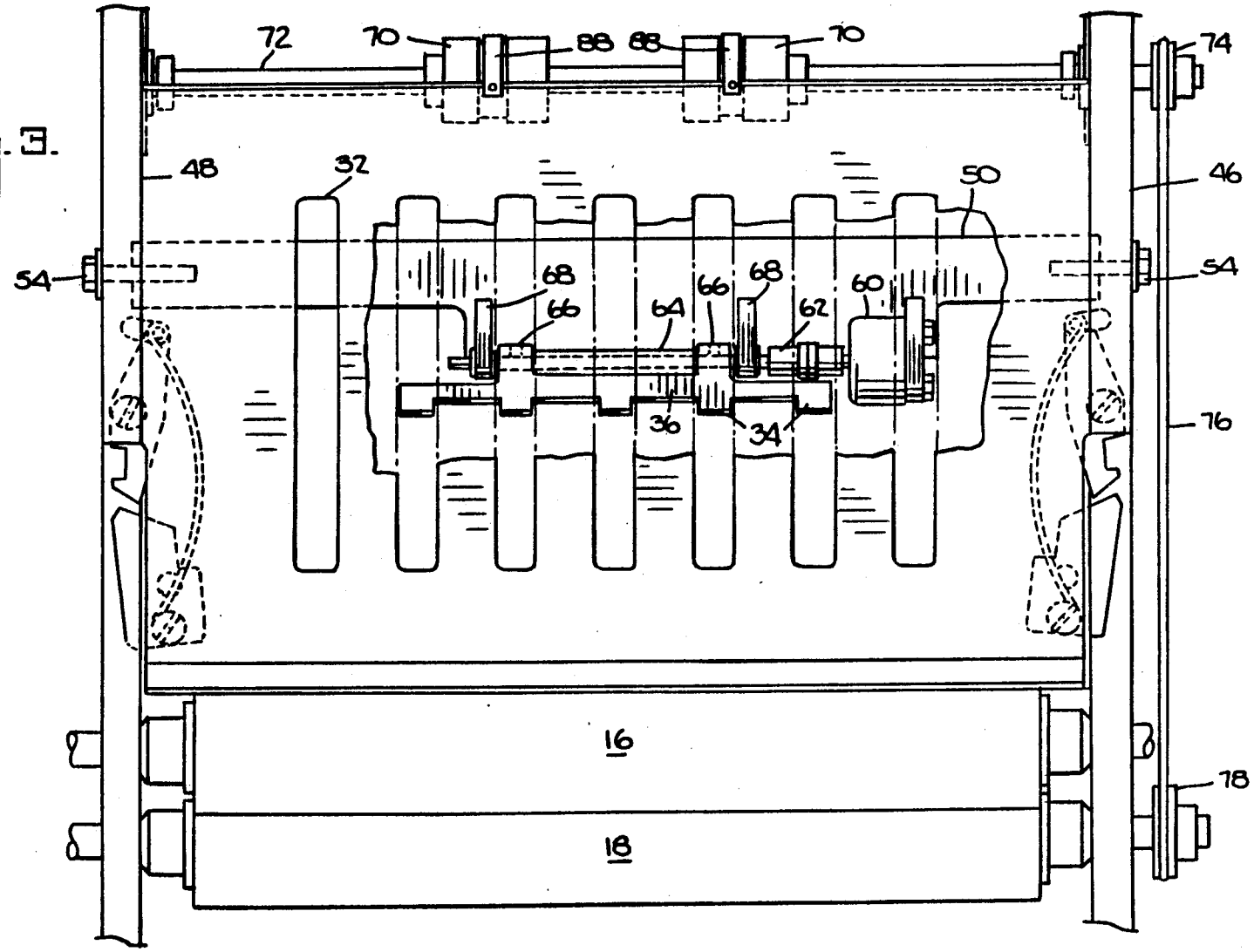
FIG. 3 is a top plan view of the buckle chute folder seen in FIG. 1.
Figure 5:
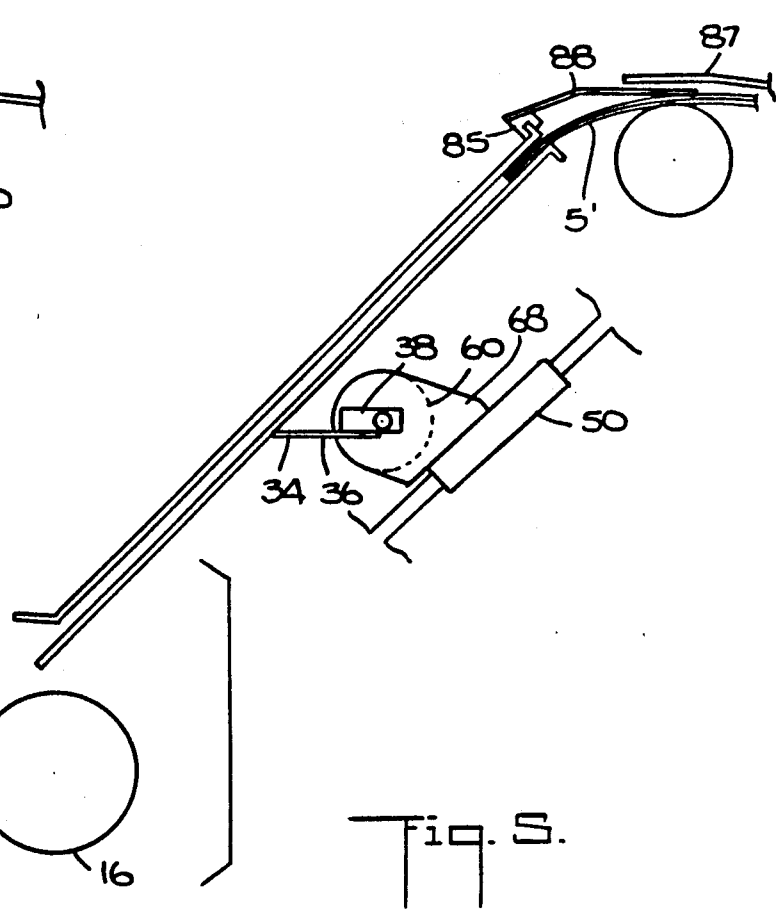
FIG. 5 is a side view of the buckle chute folder seen in FIG. 3 with the buckle chute stops withdrawn from the chute.
Figure 4:
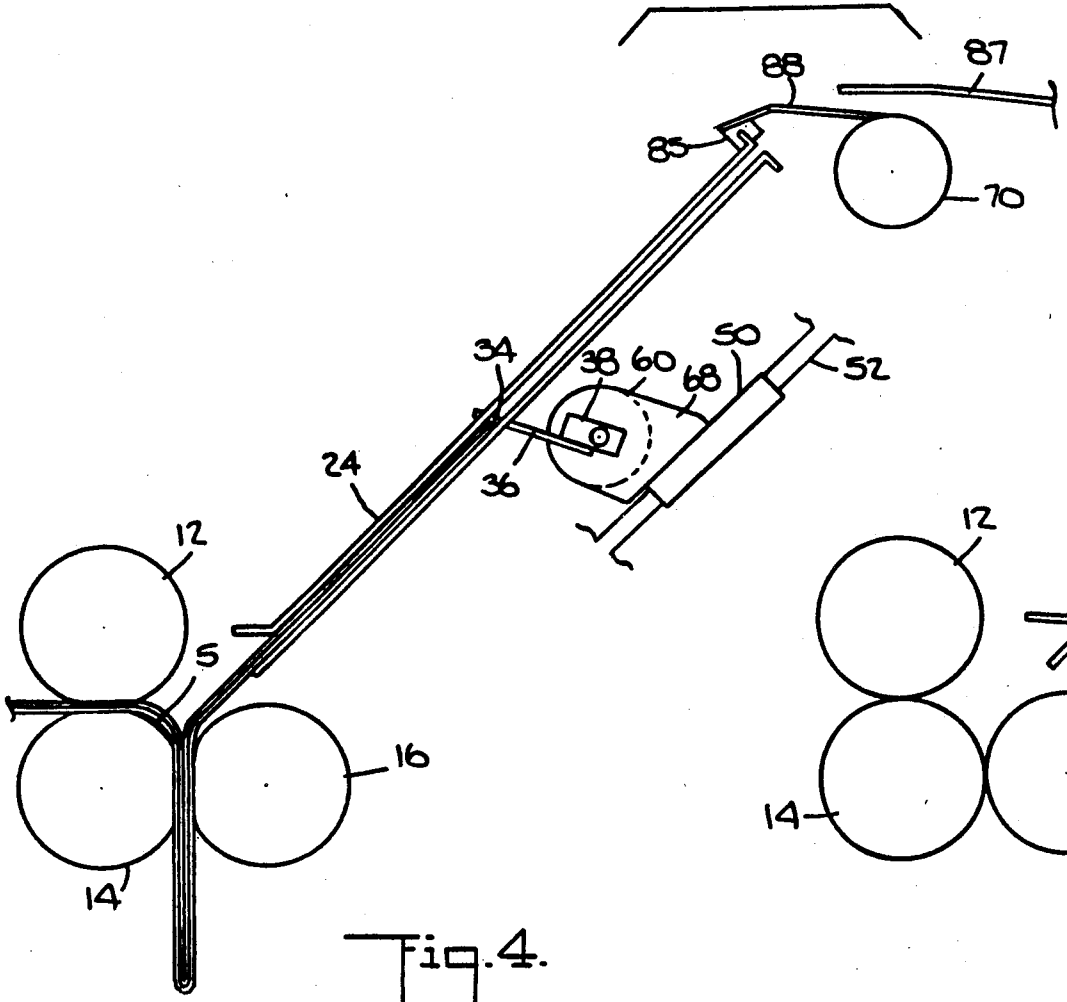
FIG. 4 is a side elevational view of the buckle chute folder with the buckle chute stops in position for folding sheets of paper.

At chute 24, stop bar 36 is part of a stop assembly 44 that, in accordance with the present invention, allows stop fingers 34 to pivot out of chute 24 so that sheets may be diverted out the top of buckle chute 24. In the preferred embodiment of the present invention, stop assembly 44 includes two vertical brackets 46 and 48 that are mounted to side frames 47 and 49. Brackets 46 and 48 are situated behind and parallel to buckle chute 24. This arrangement of brackets 46 and 48 allows buckle chute 24 to be removed independently from stop assembly 44. There is a horizontal bracket 50 which extends across the back of chute 24. Bracket 50 is adjustably mounted through slots 52 in vertical brackets 46 and 48 by thumb screws 54. There is a rotary solenoid 60 mounted to the side of bracket 50 facing chute 24. The shaft of solenoid 60 is extended by shaft coupler 62 to a length sufficient for stop bar 36 to be secured thereon. Stop bar 36 is mounted to a pair of brackets 66 which are secured the extended solenoid shaft 64. There are two shaft support members 68 through which extended shaft 64 is suitably journaled. Referring now to FIGS. 2 and 4 stop fingers 34 project through slots 32 when solenoid 60 is in a relaxed or de-energized mode. When solenoid 60 is energized stop fingers 34 are withdrawn from chute 24 as shown in FIG. 5. It will be understood that the movement of stop fingers 34 reflects the rotation of the rotary solenoid shaft between its starting and end positions. In the preferred embodiment of the present invention, the end position of the rotary solenoid represents the diverting position of stop fingers 34. An example of the rotary solenoid used in the present invention is model 9029, part number H-2437-031 manufactured by Lucas Ledex, Inc., a subsidiary of Lucas Industries of Vandalia, Ohio.

Typically, the paper path in a buckle chute is configured to end at the top of slots 32, i.e., the extreme position for stop fingers 34. It is common for conventional buckle chutes, such as chute 26, to include various screws, locking springs and the like above slots 32. In the present invention, the paper path in buckle chute 24 extends from the bottom to the top of buckle chute 24. Adjacent to the top of buckle chute 24, a pair of exit rollers 70 are secured to shaft 72 which is suitably journaled to vertical brackets 46 and 48. Shaft 72 is driven by a belt and pulley drive arrangement. Pulley 74, which is secured to one end of shaft 72, is driven by driven pulley 78 via belt 76. Pulley 78 is secured to the shaft passing through fold roller 18 In the preferred embodiment of the present invention, the diameters of pulley 74 and rollers 70 are slightly smaller than the diameters of pulley 78 and roller 18, whereby exit rollers 70 rotate at a faster speed than the folding rollers to thereby yank the diverted stack of sheets out of buckle chute 24.

Also located at the top of chute 24 are a pair of leaf springs 88, each mounted at one end to the upper lip of buckle chute 24 by mounting block and set screw arrangement 85. Rollers 70 each have a center groove towards which a spring 88 is biased for urging the sheets diverted out of chute 24 against rollers 70 so that the sheets can be fed to a stacking area. It will be understood by those skilled in the art that other biasing devices, such as a brush or strap, could be used in place of springs 88. In the preferred embodiment of the present invention, the stacking area consists of tray 80 which is mounted to the downstream end of a cover 82 for buckle chute folder 10. Cover 82 is a conventional buckle chute folder cover that has been modified by cutting a horizontal slot in the downstream end through which diverted stacks of sheets are fed into tray 80. A deflector plate 87 is mounted to the inside cover 82 and extends through the slot in cover 82 into tray 80. There are mounting brackets 86 attached to opposite sides of tray 80, which hook into recesses suitably located in cover 82 so that there is a clear paper path from buckle chute 24 to tray 80.

Conventional buckle chute folders include entrance and exit sensors 90 and 92 situated in proximity to rollers 12 and 14 and roller 20 and 22 respectively. The sensors signal the control system of the inserting machine when sheets enter and exit folder 10. In the preferred embodiment of the present invention, another sensor 94, for example an optical sensor, is used to signal the control system of the inserting machine when sheets have been diverted from folder 10.

In operation, a stack of sheets 5 are conveyed along a paper path in the inserting machine to rollers 12 and 14 which feed sheets 5 into buckle chute 24. Normally, solenoid 60 is de-energized causing stop fingers 34 to project through chute 24. In this mode, buckle chute folder 10 operates as a conventional buckle chute folder. In the preferred embodiment of the present invention, buckle chute folder 10 is configured to make two, one third folds in sheets 5. Stop fingers 34 are positioned in chute 24 so that the first one third fold is made when the leading edge of sheets 5 hit stop fingers 34, sheets 5 buckle and rollers 14 and 16 complete the first fold, as seen in FIG. 4. The remainder of the folding operation of that of a conventional buckle chute folder which is configured like folder 10. Sheets 5 sequentially engage deflector 28, rollers 16 and 18, conventional buckle chute 26, fold rollers 18 and 20, deflector 30 and rollers 20 and 22 to complete the fold.

Referring now to FIG. 5, when the control system of the inserting machine determines that a stack of sheets 5' must be diverted, the control system energizes solenoid 60 causing stop fingers 34 to pivot out of chute 24. Solenoid 60 is energized before the stack to be diverted is conveyed into chute 24, but after the previous stack has been processed through the folder as determined by sensor 94 or the folder exit sensor 92. Rollers 12 and 14 convey stack 5' through chute 24 until the leading edge of stack 5' is engaged by exit rollers 70 which propel stack 5' out of chute 24, through slot 83 in cover 82 and into tray 80. Brush 88 forces stack 5' into contact with rollers 70. An operator can now remove the diverted stack from tray 80 for separate processing without the need to interrupt the normal operation of the inserting machine.

In the preferred embodiment of the present invention, a sensor (not shown) detects when cover 82 is removed. An appropriate signal is sent to the control system which energizes solenoid 60. This causes stop fingers 34 to pivot out of buckle chute 24 thereby providing access inside the chute, for example, to clear paper jams.

The preferred embodiment of the present invention has been described for a six roller, double fold, buckle chute folder in an inserting machine. It will be understood by those skilled in the art that the present invention is suitable for any buckle chute folder, including four roller, single fold folders. It will also be understood that the present invention is not limited to buckle chute folders in an inserting machine.

It will be appreciated that there has been provided in accordance with the present invention a diverting apparatus and method for in-line inserting equipment that fully satisfies the objects, aims and advantages set forth above. While the invention has been described in conjunction with specific embodiments thereof, many alternatives, modifications and variations will be apparent to those skilled in the art. Accordingly, it is intended to embrace all such alternatives, modifications and variations that follow within the spirit and scope of the appended claims.

What is claimed is:

1. A method of diverting one of more sheets from a first paper path, comprising the steps of:

a) providing a buckle chute folder having a pair of fold rollers and at least one buckle chute having an inlet and an outlet;

b) pivotally mounting stop fingers to said buckle chute and coupling said stop fingers to a solenoid;

c) pivoting said stop fingers to extend through slots in said buckle chute to initiate a fold in the sheets conveyed into said inlet along a first paper path causing the sheets to buckle into a nip of said fold rollers which convey the sheets along the first paper path for further processing;

d) providing a second paper path that is an alternate to the first paper path for conveying only unfolded sheets that are diverted from said first paper path;

e) pivoting said stop fingers out of said slots in said buckle chute to divert the sheets through said outlet which begins said second paper path; and f) feeding said sheets to said inlet of said buckle chute by a pair of feed rollers.

2. The method according to claim 1, comprising the further steps of:

f) providing an exit roller at the outlet of said buckle chute; and g) conveying the sheets being diverted to a stacking area at the end of said second path.

3. The method according to claim 2, comprising the further step of:

h) sensing when the diverted sheets have been conveyed out of said buckle chute; and i) returning said stop fingers to a fold position in said buckle chute by de-energizing said solenoid.

4. Apparatus for diverting individual sheets from a first paper path, comprising:

a buckle chute folder comprising:

at least one buckle chute, having an inlet which is part of a first paper path and an outlet which begins a second paper path that is an alternate path to said first paper path;

a pair of folding rollers adjacent to said buckle chute, said folding rollers being part of said first paper path;

means for conveying one or more sheets along said first paper path into said inlet of said buckle chute; and a stop member assembly operatively coupled to said buckle chute, said stop member assembly including at least one stop finger coupled to a solenoid for moving said stop finger between a fold position and a divert position in said buckle chute;

said stop finger being in said fold position to deflect the leading edge of the sheets causing the sheets to buckle into the nip of said folding rollers, said folding rollers conveying said sheets downstream for further processing along said first paper path; and said stop finger being in said divert position to divert said sheets from said first paper path to said second paper path, said second paper path being used only to convey unfolded sheets diverted from said first paper path.

5. The apparatus according to claim 4, wherein said solenoid is a rotary solenoid, said stop finger being coupled to a shaft of said rotary solenoid.

6. The apparatus according to claim 4 wherein said stop fingers extend through said buckle chute when said solenoid is de-energized, and said stop finger pivot out of the chute when said solenoid is energized.

7. The apparatus according to claim 4, further comprising:

an exit roller adjacent to said outlet of said buckle chute.

8. The apparatus according to claim 7 further comprising means for biasing the diverted sheets against exit roller.

9. The apparatus according to claim 8 wherein said biasing means comprises a spring biased towards said exit roller.

10. The apparatus according to claim 4 wherein said stop fingers are adjustably positionable between said inlet and said outlet of said buckle chute.

11. The apparatus according to claim 4, further comprising a stacking bin at a downstream end of said second paper path for stacking sheets diverted through said second open end of said buckle chute.

12. The apparatus according to claim 4, further comprising means for sensing when said sheets being diverted have been conveyed out of said second open end of said buckle chute wherein said solenoid returns said stop finger to said fold position.

* * * * *